US005683065A

United States Patent [19]

Allen

[11] Patent Number: 5,683,065

[45] Date of Patent: Nov. 4, 1997

[54] SUSPENDED SEATING APPARATUS

[75] Inventor: Carling D. Allen, Orem, Utah

[73] Assignee: Seating Innovations L.L.C., Orem, Utah

[21] Appl. No.: 670,628

[22] Filed: Jun. 26, 1996

Related U.S. Application Data

[63] Continuation-in-part of Ser. No. 559,615, Nov. 20, 1995.

[51] Int. Cl.[6] ..... A47B 83/02

[52] U.S. Cl. ..... 248/282.1; 248/163.1; 248/323; 248/417; 297/142; 297/174

[58] Field of Search ..... 248/650, 676, 248/677, 121, 122.1, 163.1, 219.2, 278.1, 279.1, 282.1, 285.1, 289.31, 323, 326, 370, 417; 297/344.1, 344.21, 344.22, 344.24; 403/174, 176, 362

[56] References Cited

U.S. PATENT DOCUMENTS

| | | | |
|---|---|---|---|
| 205,291 | 6/1878 | Neisser | 248/285.1 X |
| 944,461 | 12/1909 | Olander | 248/650 X |
| 2,936,530 | 5/1960 | Bowen | 403/176 X |
| 2,964,202 | 12/1960 | Gingher et al. | 248/121 X |
| 2,984,485 | 5/1961 | Brown | 248/121 X |
| 3,376,007 | 4/1968 | Chesterley | 248/285.1 |
| 3,462,021 | 8/1969 | Hawke et al. | 403/174 X |
| 3,669,392 | 6/1972 | Saunders | 248/121 |
| 3,737,195 | 6/1973 | Black et al. | 297/142 |
| 5,265,838 | 11/1993 | Kjellman | 248/289.31 X |
| 5,352,014 | 10/1994 | Allen | 297/142 |

FOREIGN PATENT DOCUMENTS

| | | | |
|---|---|---|---|
| 250140 | 9/1926 | Italy | 297/344.21 |

*Primary Examiner*—Alvin C. Chin-Shue
*Assistant Examiner*—Derek J. Berger
*Attorney, Agent, or Firm*—M. Ralph Shaffer P.C.

[57] ABSTRACT

Suspended seating apparatus comprising a chair supporting structure with an extensible cantilever arm and adjustable base structure for balancing the cantilever effect and also for accommodating one or a pair of suspended seating arrangements.

18 Claims, 7 Drawing Sheets

SUSPENDED SEATING APPARATUS

This is a continuation in part of pending U.S. patent application by the same title, Ser. No. 08/559,615, filed Nov. 20, 1995, group art unit 3507.

FIELD OF INVENTION

The present invention relates to suspended seating constructions and, more particularly, provides a suspended seating apparatus suitable for accommodating bars, tabletops, cabinets, and the like, wherein an extensible cantilever is employed to mount the journal box accommodating the suspended seating.

BRIEF DESCRIPTION OF PRIOR ART

There is considerable patent literature, including some of the inventor's own patents, e.g., U.S. Pat. No. 5,352,014, as well as the inventor's pending U.S. patent application, Suspended Seating Device, Attorney's Docket No. 12091, which deal with suspended seating in general. The literature generally teaches the concept of suspended seating useful for supplying seating for counter tops, tables, kitchen bars, and the like, wherein there is no direct support disposed underneath the seat and engaging the floor. Rather, the seating customarily employs an arm that swivels in its journal mount related in one way or another to the counter top or table with which it is associated.

In certain types of built-in-type and other table or breakfast-bar structures, there is necessitated a rather substantial forward extension of the journal box accommodating the arms of the suspended seating, this for accommodating for centrally mounted structures and also corner mounted installations. To balance the cantilever effect, it would be desirable, and the present invention contemplates, for the introduction and usage of a forwardly directed base structure that can be manipulated for stacking purposes for shipping, and also that can be conditioned for floor leveling purposes, as well as for counterbalancing the downward torquing effect produced when individuals are actually seating in the suspended seating installation. Without this, there could be a disruption of the mount of the suspended seating support structure.

The present invention counteracts this tendency by supplying a base construction suitable for both leveling the assembly and, more importantly, for counterbalancing the cantilever effect of the cantilevered arms used in the invention for securing the suspended seating arms.

BRIEF DESCRIPTION OF THE INVENTION

Accordingly, the present invention addresses the goal of supplying a cantilevered-type of suspension arm apparatus which is adjustable as to forward extension, and which is counterbalanced by adjustable base structure that can be manipulated for shipping purposes. The cantilever arm of the structure telescopes preferably within a tubular member affixed to a upstanding support post. Correspondingly, there is base structure provided wherein a base arm telescopes preferably within a base arm receptacle likewise affixed to the support post, only at its bottom. Outwardly extending foot-extension structure is supplied with leveling means and for further counterbalancing the suspended seating construction. The base support structure of the apparatus employs an extensible foot or toe, whereby to allow for the balance fulcrum, i.e. at the toe, to be extended outwardly to a position essentially beneath or even outwardly beyond the journal box of the seat support arms and to be emplaced in a customary, obtuse, inside corner, generally of the order of 135 degrees, as sometimes employed in built-in enclosure step structure which will generally added to the construction as a finishing enclosure.

Structure is provided for mounting flexibility, height adjustment, and also unique alignments of arms or equivalent members relative to their receiving sleeves, both in the context of cantilevered seat support structures, and taken separately.

This structural approach is useful for one or more extension arms for the single- or multiple-seating desired.

OBJECTS

Accordingly, a principal object of the present invention is to provide a new and improved suspended seating apparatus.

A further object is to provide suspended seating apparatus incorporating a cantilever, of adjustable type for journaling and retaining support arms of suspended seating.

A further object is to provide a cantilevered suspended seating apparatus wherein the same includes an extensible base structure suitable for counterbalancing the cantilever effect of the apparatus and yet designed for manipulation for suitable shipping and storage purposes.

A further object of the invention is to provide a cantilevered suspended seating construction wherein both the suspension arms as well as the seat journals are supplied with torsion spring structure and appropriate stops, for urging and likewise delimiting rotational displacements of the seat and the arms in accordance with operating conditions to be desired.

A further object is to provide flexible mounting structures and also control of telescoping parts, whereby to achieve a high degree of desired alignments.

BRIEF DESCRIPTION OF DRAWINGS

The present invention, both as to its organization and manner of operation, construction, and assembly is best understood by reference to the following drawings, taken in connection with the description that follows, in which.

DETAILED DESCRIPTION OF PREFERRED EMBODIMENTS

Figure 1:
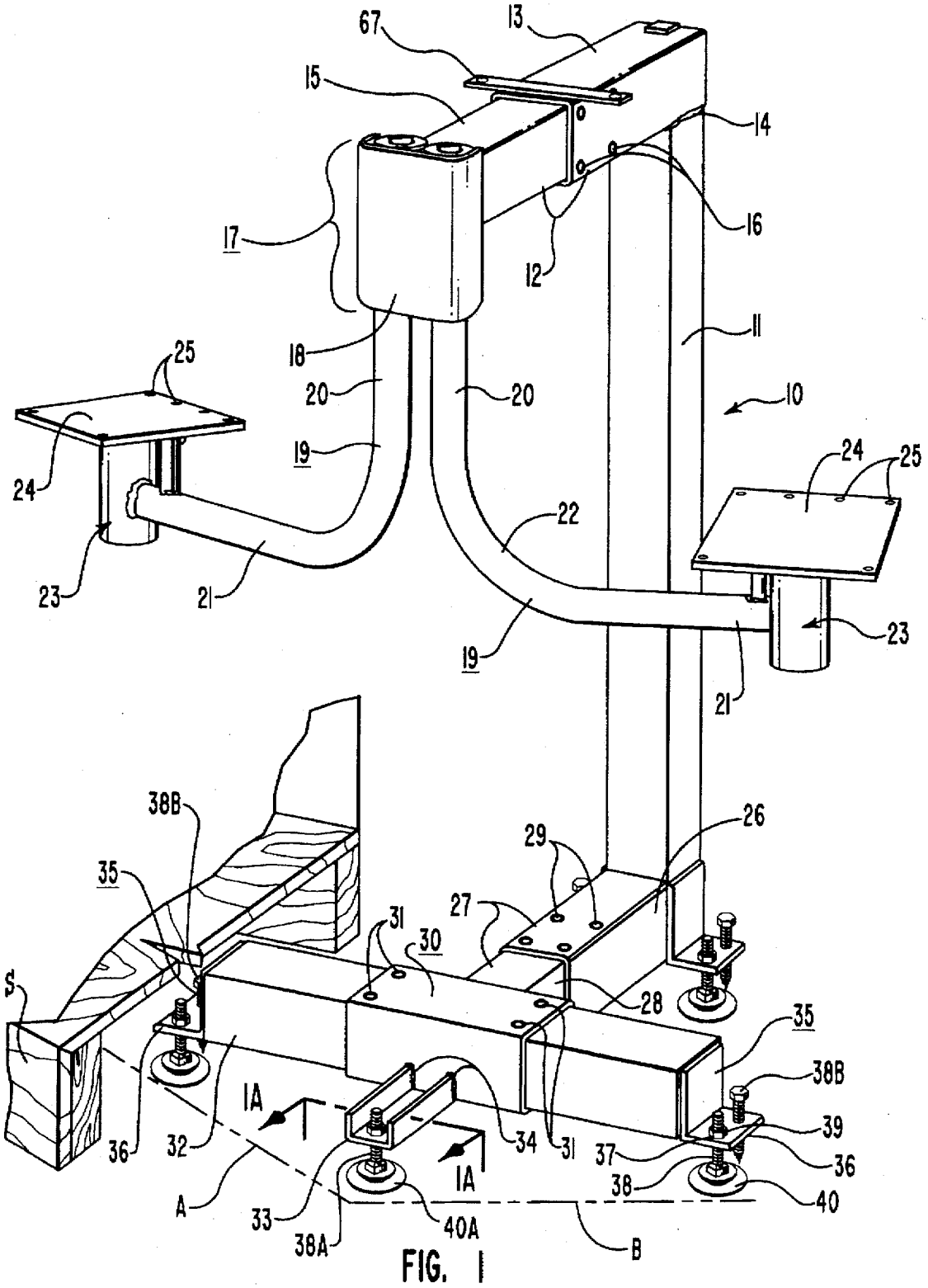
FIG. 1 is a perspective view, partially broken away, of suspended seating apparatus constructed in accordance with the principles of the present invention.

In FIG. 1 suspended seating apparatus 10 shown to include a post 11 and, secured to the upper end thereof as by welding, a composite arm 12 forming a cantilever. Constituting the composite arm 12 is a tubular member 13, secured by welding at 14 to the upper end of the post 11 and, slipping into tubular member 13, a cantilever arm 15. For particular chosen positions of the cantilever arm 15 relative to tubular member 13, set screw attachments 16 may be supplied tubular member 13 for temporarily and releasably securing the cantilever arm 15 in a desired location relative to the post 11.

Secured to the outer end of cantilever arm 15 is a support arm journal box 17 that includes cover 18. The details of this journal box will be described hereinafter. Suffice it to say at this point, the arms 19 depend from the journal box 17 and comprise respective first and second arm portions 20 and 21 which join in an intermediate curve area 22. Secured to the respective outer ends of second arm portions 21 are seat plate journal boxes 23 each of which supports a respective seat plate 24. The latter are provided with apertures 25 accommodating screws which proceed from beneath the same to screw into the seats employed, not shown.

To the lower extremity of post 11 is secured an outwardly extending base arm receptacle 26 of composite base arm 27. The latter also includes base arm extension 28 which is secured in the receptacle 26 by means of set screws 29. To the outermost end of base arm extension 28 is secured a cross arm, e.g., item 32 per se welded directly to member 28, or receptacle 30, the same likewise including set screw attachments 31. Telescoping slidably placed within cross arm receptacle 30 is an adjustable member 32, or a pair of end-to-end disposed members 32, secured in place by the set screw attachments 31 as previous mentioned. To the cross arm receptacle 30 is secured an outwardly extending foot or toe extension 33 that can be welded in place at welds 34.

To the opposite ends of adjustable member 32 are secured brackets 35 which have lower flanges 36. The lower flanges 36 include drilled and tapped apertures at 37 that accommodate the threaded introduction of the threaded shanks of carriage bolts 38. These carriage bolts 38 comprise adjustable leveling bolts that can be secured in place, by position-fixing nuts 39, and thus be tightened down for a desired height location by nuts 39. Washers 40, 40A are provided for self-centering purposes and also to preclude the lower rounded ends of the respective carriage bolts from dimpling the floor surface. See FIG. 1A.

The inclusion of the leveling bolts at the opposite ends of adjustable member 32 will be the same relative to foot extension 33, in which event items 38A–40A correspond to items 38–40, respectively, as seen at the lower right hand portion of FIG. 1.

Figures 1A, 2:
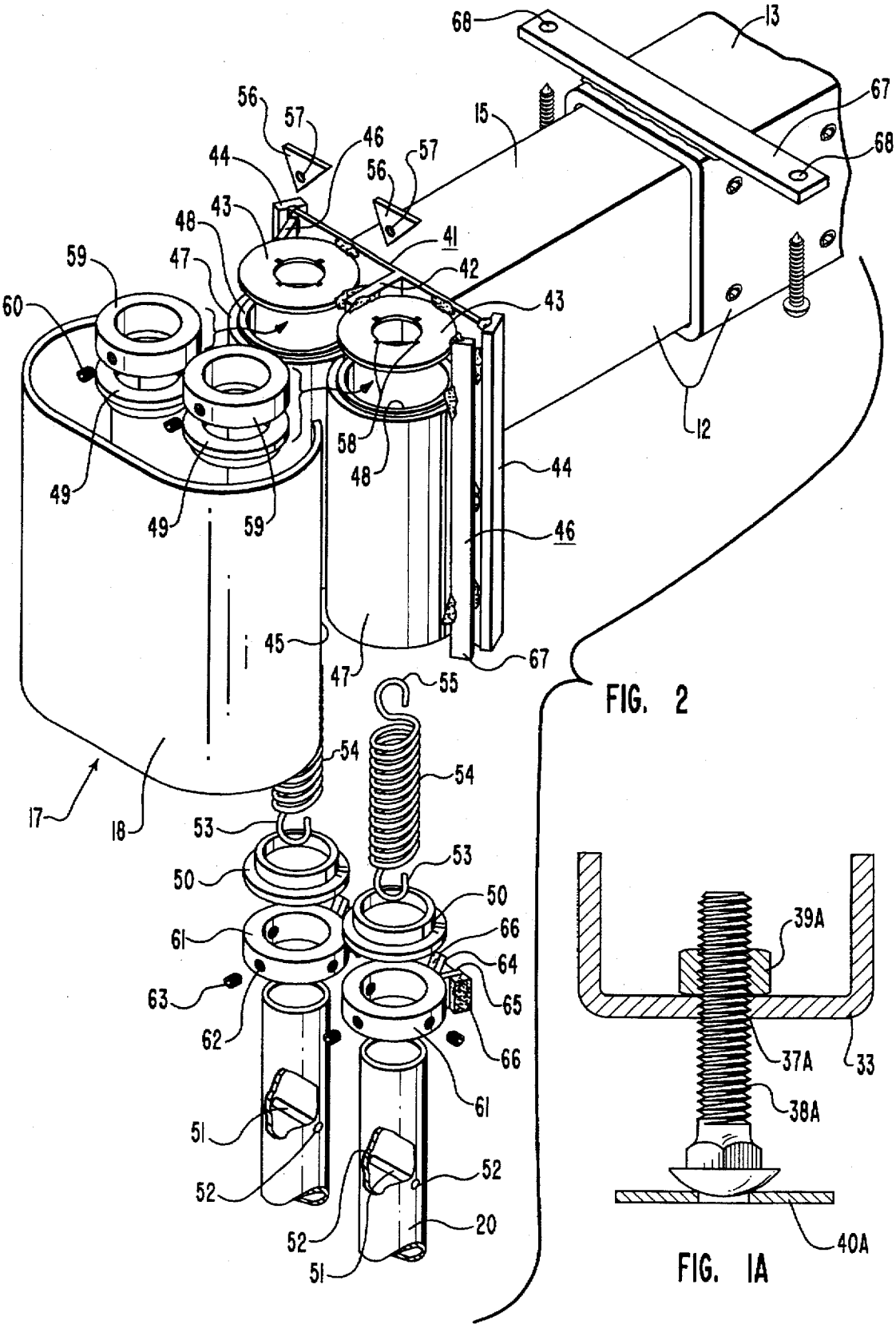
FIG. 1A is an enlarged transverse section taken along the line 1A—1A in FIG. 1, illustrating the foot extension, floor height adjustment feature of the invention.
FIG. 2 is an enlarged exploded view of the upper portion of the structure of FIG. 1, showing in detail the journal mounts and associated structure relating to the journal box accommodating the upward extensions of the seat arms of FIG. 1.

The details of the upper portion of the apparatus seen in FIG. 1 are shown in FIG. 2. Thus, to the outer end of cantilever arm 15 is welded an end plate 41 having medial spacer 42. To the end plate and spacer are welded rings 43, and to the outer edges of the plate 41 are welded attachment strips 44. These strips will aid in the securement of cover 18, preferably edge-resilient, by the latter's looping grasp by its opposite edges 45, on the one being shown, about the respective strips 44. A vertical stop-bar (not shown, but disposed between and depending from the outer tubes 47) can be used to delimit travel of the seat arms when swung in a reverse direction to stored position, and will be engaged by respective the bumper pads 66 shown in FIG. 2.

Also included in this structure are elongated bumper plates 46 which are welded in place as indicated, both to the plate structure and also to respective outer tubes 47. Pressed into the outer tubes 47 are the inner journal cylindrical tubes 48. Disposed within the opposite ends of tubes 48 are flanged bushings 49, inserted into the respective upper ends, and also corresponding flanged bushings 50 inserted into the bottom of the respective tubes 48. Upper arm portions 20 include cross pins 51 which are disposed in the arm apertures 52 provided. These pins 51 serve to receive and anchor the lower hook portions 53 of respective torsion springs 54. The upper ends 55 of the respective springs will be retained by triangular keys 56, these keys being provided with apertures 57 for receiving such upper spring ends. These will fit into selected notches 58 of rings 43 which define keyway slots. Thus, the bearings 49, co-acting with bearings 50, will serve to journal the upwardly extending arm portions 20. Stop collars 59 will be secured by respective set screws 60 to the upper ends of arm portions 20 to keep these from dropping down and out of engagement with the journal box 17. Stop collars 61 are provided with respective apertures 62 accommodating set screws 63. These stop collars likewise include respective, outwardly directed ribs or flanges 64 and 65 to which bumper pads 66 are secured as by an appropriate adhesive. These bumper pads engage the lower extremities 67 of strips 46 so as to delimit the pivotal movement, about the arm portion's vertical axes, of such arms. Appropriate placement of the stop collars 61 is achieved through the tightening down of their respective set screws 63.

If desired, the tubular member 13 may be provided with an attachment plate 67 having apertures 68 receiving attachment screws which will screw into the underside of a table or cabinet top or bar, not shown.

Figure 3:
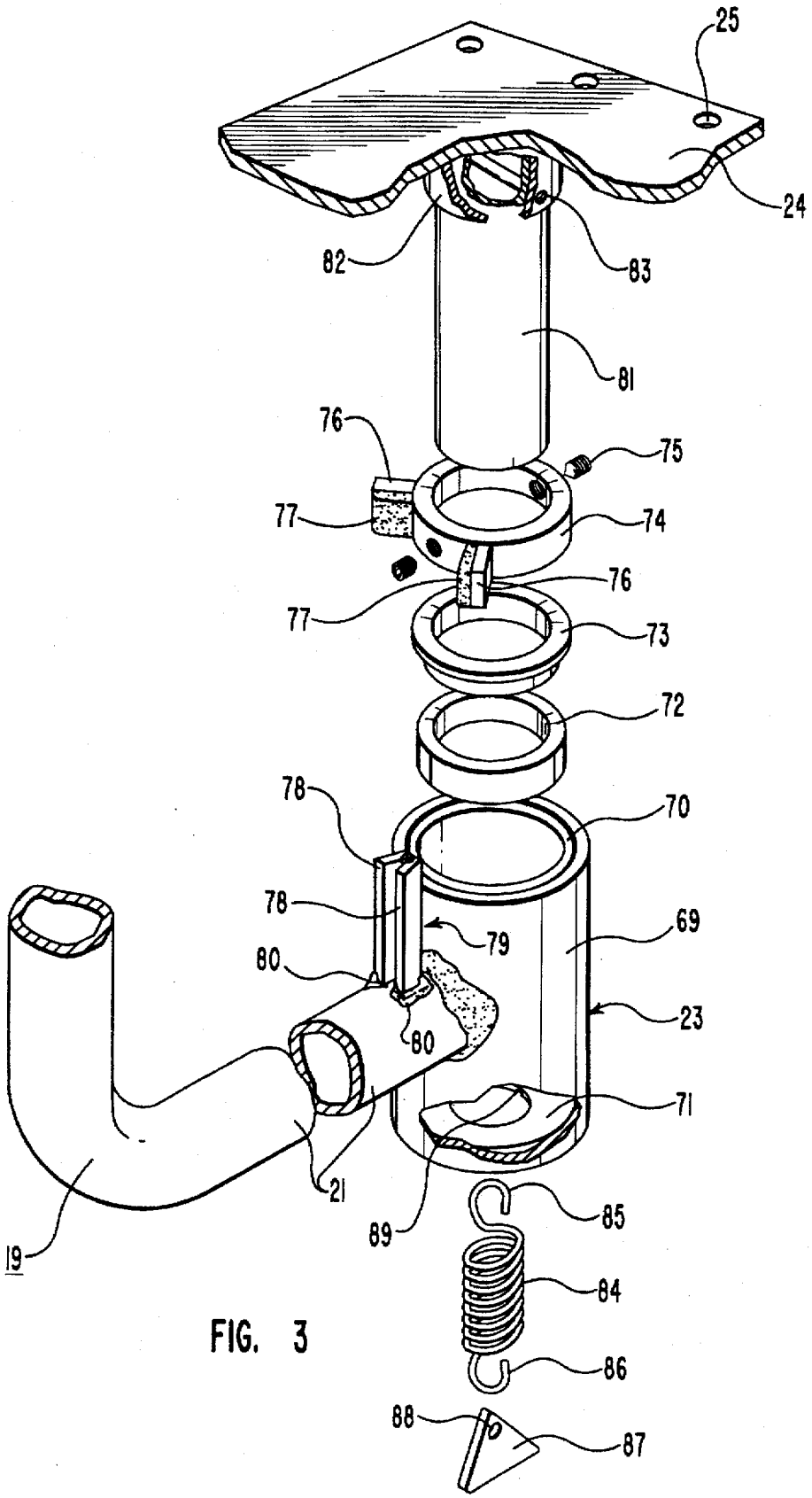
FIG. 3 is an exploded perspective view of a representative seat support plate journal with associated structure.

In FIGS. 1 and 3 seat plate journal box 23 has an outer cylindrical tube 69 and also an inner cylindrical tube 70 pressed therein. To the bottom of outer cylindrical tube 69 there is welded a washer 71 and, disposed upon that washer, will be bushing 72. Bearing 73 is inserted downwardly to fit against and within the upper end of cylindrical tube 70. A stop collar 74 includes set screws 75, is similar to the stop collars 61 in FIG. 2, and incorporate outwardly extending flanges 76 which have on their respective surfaces bumper pads 77. These are designed to engage the outer surfaces of upstanding strips 78 that are welded to the outer surface 79 of outer tube 69, as well as being welded at 80 to the lower arm portion at 21. Stop collar 74, of course, will be secured to the tubular post 81 which depends from and is secured to seat support plate 24. The securement may take the form of a depending boss 82, welded to the underside of seat plate 24 and which receives tubular post 81, the latter being secured thereto by cross pin 83. When the structure shown in FIG. 3 is assembled, then the torsion spring 84, having hook portions 85 and 86, will connect to pin 83, as to hook portion 85, and to retainer key 87 at its aperture 88 as to hook portion 86. Washer 71 can include a series of small key-way indentations 89, one being shown, for receiving the angulated sides of representative key 87. Accordingly, when the structure is assembled, the post 81 will be journaled within the journal box 23, see FIG. 1. Yet, the rotative movement of the plate 24, and the chair (not shown) to which it attaches, about the vertical axis of post 81 will be delimited by virtue of the selected impact of one of the bumpers or bumper pads 77 relative to a respective plate 78.

Figure 4:
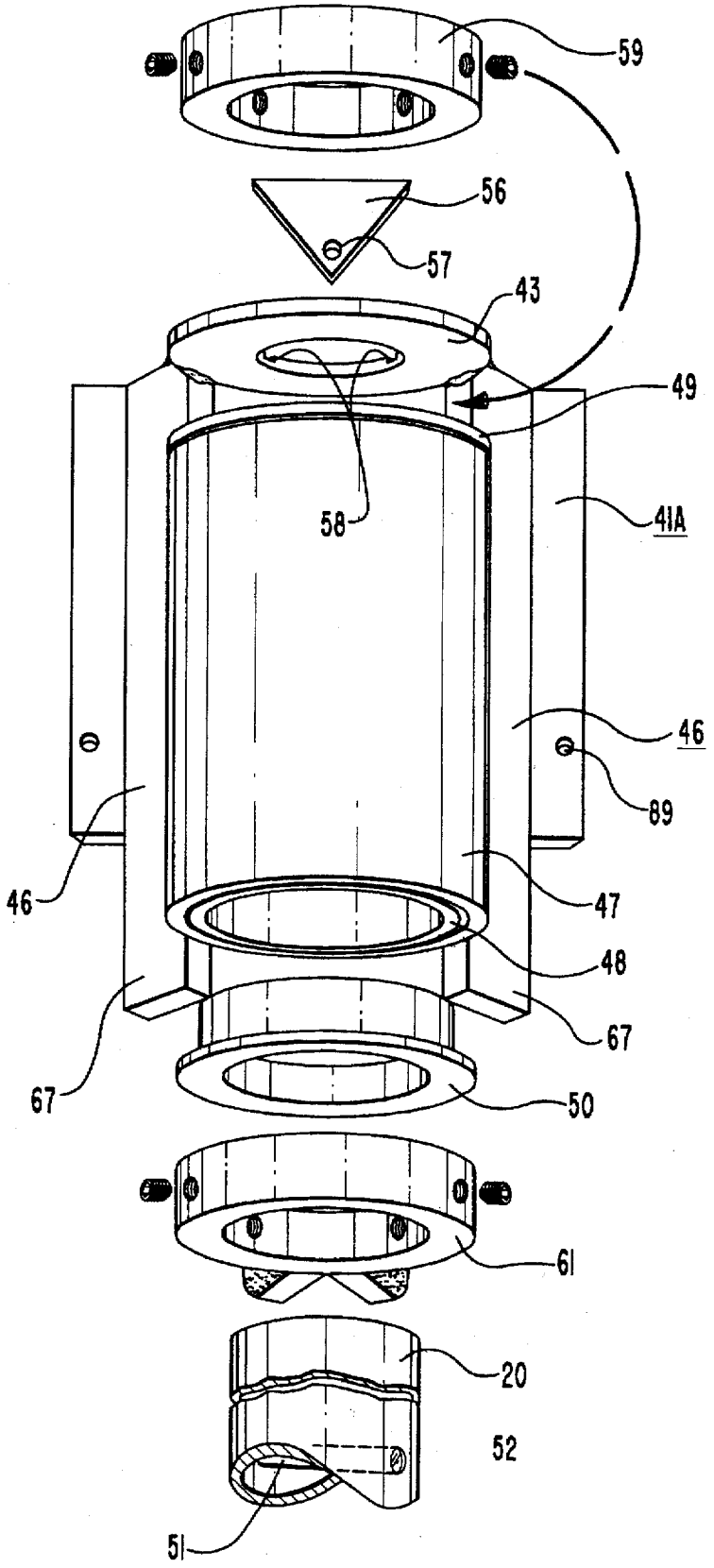
FIG. 4 is similar to FIG. 2 but illustrates the journal mount for the suspension seat arm where but a single seat arm is employed for attachment to the cantilever support arm of the apparatus.

Rather than a pair of journals at the journal box 17, but a single journal and suspended seat arm can be employed at the outer extremity of cantilever arm 15. FIG. 4 illustrates this condition wherein the end plate 41A, corresponding to end plate 41 in FIG. 2, this time merely includes a single journal box structure accommodating a single arm portion 20. The parts remain essentially the same, and like numerals are employed, see FIG. 2. This time, however, but a single suspended seating shaft or arm is accommodated. End plate 41A therefore need not include the medial partition or portion 42 as seen in FIG. 2. Attachment apertures 89 relative to connection to the outer plate 18 can be provided.

Figure 5:
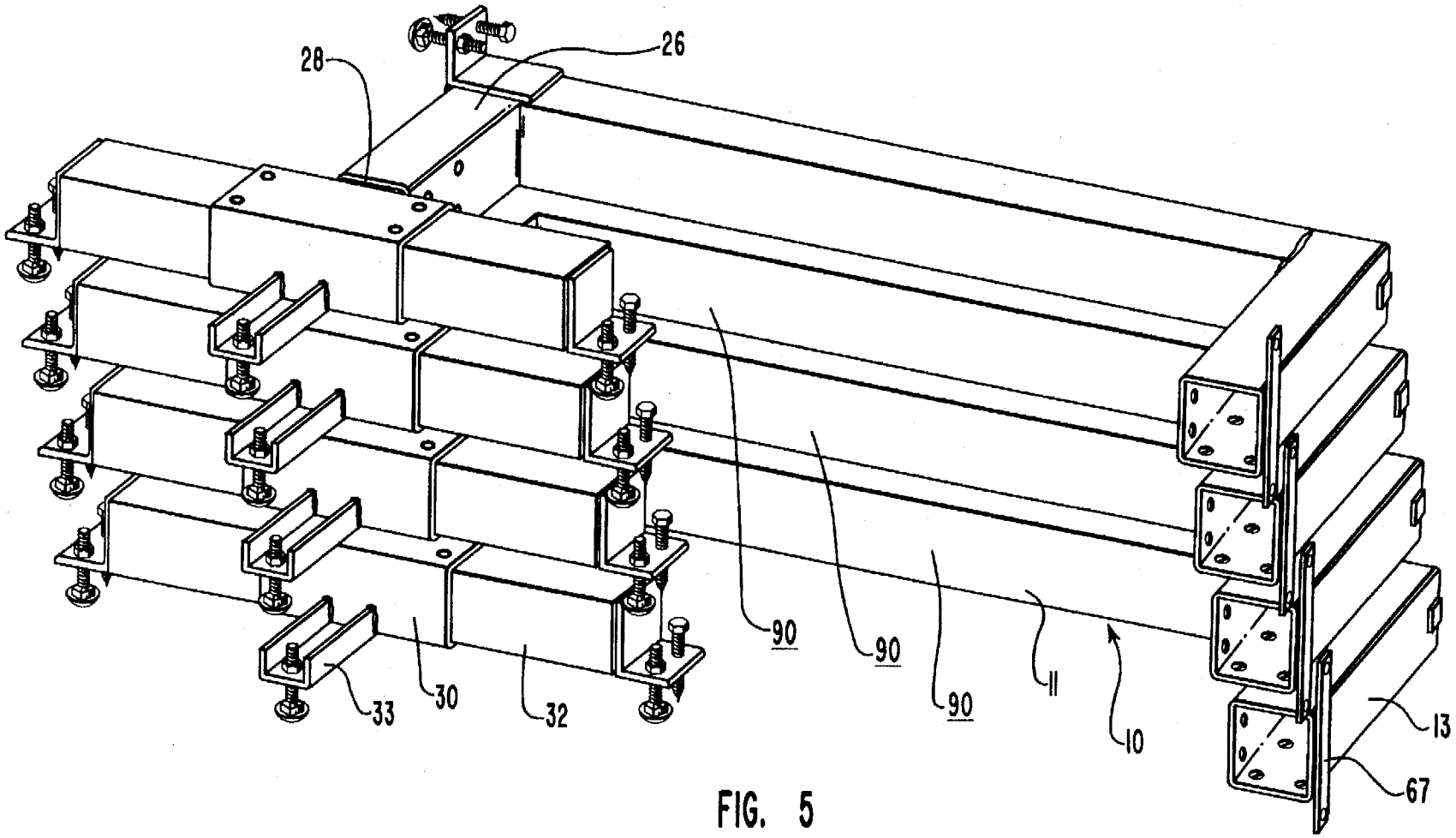
FIG. 5 is a perspective view of stacked sub-assemblies of multiple suspended seating apparatus, the journal arms and seats being removed, this figure illustrating that the base structure of the apparatus can be manipulated so as to be rotated 90 degrees whereby the base structure can lie in the same plane as the cantilever tubular members of the sub-assemblies.

Preferably the cross arm receptacles 30 in FIG. 1 may have square tubular cross sections. Correspondingly, adjustment member 32, one or even two are disposed end to end, may likewise have a square and cooperating cross section. Members 26 and 27 in FIG. 1 preferably have cooperating transverse square cross sections of telescoping nature. Thus, the structure which includes base arm extension 28 can be removed from member 26, upon the loosening of set screws 29, and the structure 28, 30 rotated 90 degrees and reinserted into member 26 so that the condition, suitable for stacking as seen in FIG. 5, obtains. Accordingly, the sub-assemblies 90 of suspended seating apparatus 10 may be stacked in a vertical pattern as seen in FIG. 5 for strapping to a suitable pallet for shipping purposes. The remainder of the structure including arms 19 and their attachments may be shipped upon a separate pallet and stacked together.

Accordingly, what is provided is a new and improved suspended seating apparatus where a cantilever arm and compensating base extension structure are provided.

In assembly and operation, the unit is shipped to the installation site as seen in FIG. 1, are unstacked, and the base members 28, 30 re-installed to the 90 degree configurement as seen in FIG. 1. The journal boxes at 17 in FIG. 2 can be preassembled, or the structure shown with the respective arms 19 can be assembled and installed at the job site. The details of the assembly are indicated in FIG. 2 relative to two arm structures and FIG. 4, relative to a single arm suspended seating structure. In both cases the seat assemblies will be the same as seen in FIG. 3. The leveling function can be achieved by the appropriate adjustment of carriage bolts 38, see FIG. 1, and the subsequent tightening down of attachment screws at 38B which pass through untapped holes, whereby to secure the structure to the floor. Once the installation is complete and the cantilever extensions determined, with the appropriate extension of base arm extension 28 in FIG. 1, then the entire assembly or apparatus is tightened down and the step structure S built as finished structure to cover the extensible base structure of the apparatus.

Relative to FIG. 1, intersecting lines A and B at the bottom of the figure, generally of the order of 135 degrees, define an inside corner of polygonal, wooden or other step structure found in, e.g., kitchen bars, which essentially correspond to the multi-sided periphery of the bar top, not shown. Where the upper arm 15 of FIG. 1 is extended outwardly at, for example, a bar top obtuse corner, then, for balance, the fulcrum as defined by the foot or toe 33 and bolt 38A, will likewise need to be extended outwardly, at or beyond the vertical projection of journal box 17, and as far as possible into the inside corner of step structure S as defined by lines A and B in FIG. 1. This is thus made possible, see FIG. 1, with the foot or toe 33 being extended outwardly and essentially fitted into the corner defined by lines A and B. Yet, the member 32 and its leveling attachments provide lateral support and preclude side-sway failure with the presence of apparatus-loading as by seating use.

Figure 6:
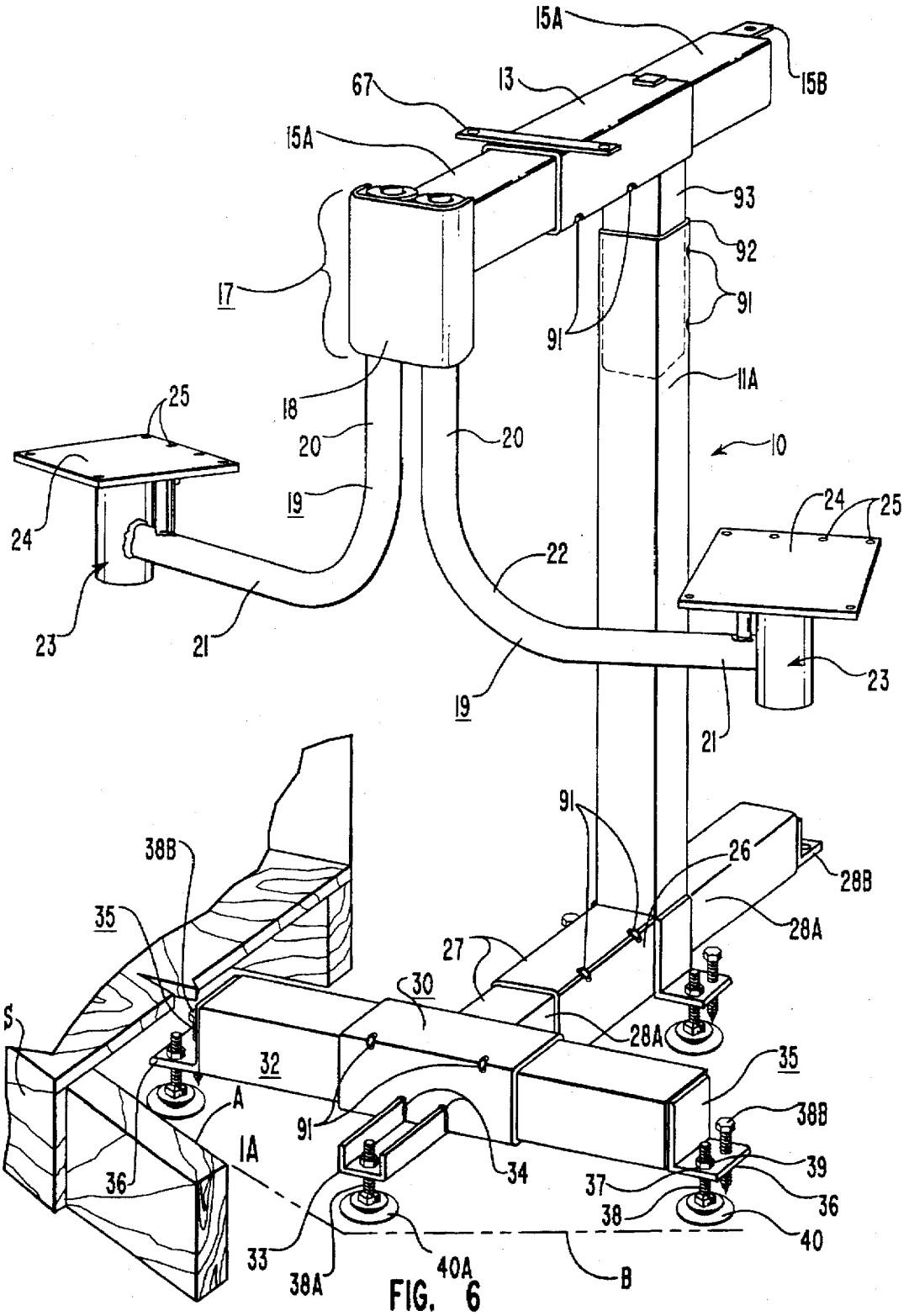
FIG. 6 is a persuective view of an alternate form of the invention, is similar in (1) construction, as seen by numeral duplications, and also (2) operation of the equipmemt as shown in FIG. 7, but also incorporates some improvements which will be fully described hereafter.

The structure of FIG. 6 is essentially the same as that of FIG. 1, but with the following modifications: Telescoping arm 14A includes a rear-end, apertured anchoring bracket 15B for anchoring purposes; member 28A likewise includes an anchoring bracket, i.e. apertured anchoring bracket 28B, and brackets 15B and 28B are designed to accommodate anchoring lag screws, bolts, or similar structures, not shown; upstanding riser or post 11A has an upper extremity 92 into which is telescoped, for height-adjustment purposes, the depending post section 93, the latter being integral with tubular member or sleeve 13 and positioning set screws 91 being employed. The tubular members 30 and 13 likewise include corner-receiving set screws 91, which are used, e.g., to anchor the relative dispositions of the members 32 and 15A relative to tubular members 30 and 13.

Figure 7:
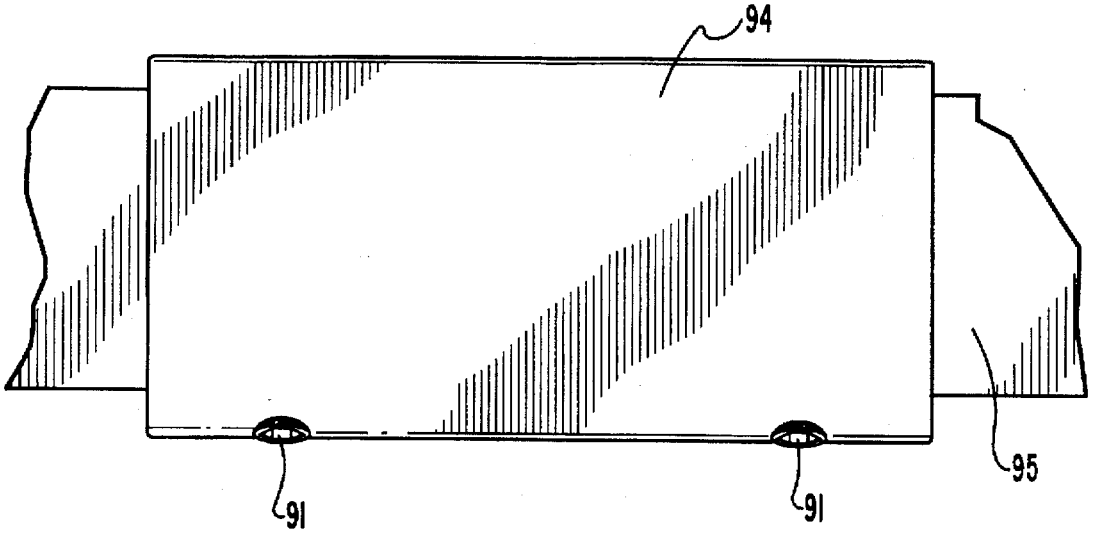
FIG. 7 is a view of certain typical telescoping structures in FIG. 6, illustrating that set screws located at a chosen corner of a tubular member, can be advantageously employed.
Figure 8:
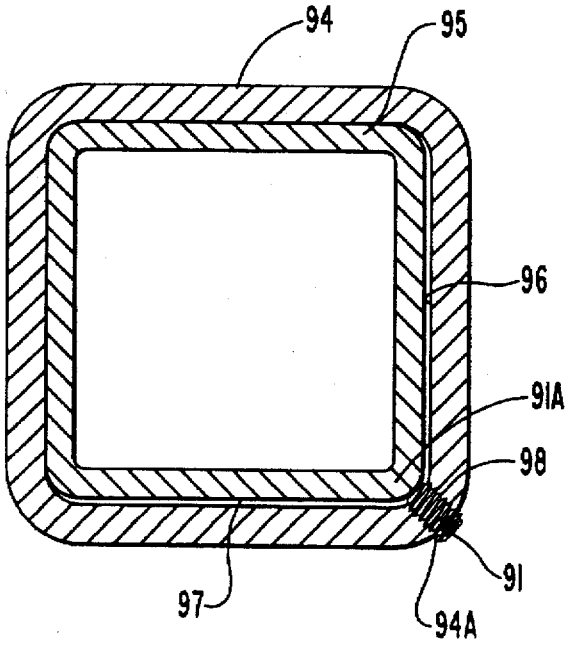
FIG. 8 is a representative transverse vertical cross-section as taken through the set screws and related structure in FIG. 7.

FIGS. 7 and 8 illustrate generically the means by which tubular members 30 and 13, by way of example, are employed to align their respective internal members or arms 32 and 13. Thus, a generic tube 94, corresponding to 30, 13, has essentially a rectangular, generally square, transverse cross-section and receives member 95 which can be of corresponding cross-section. To permit the telescoping effect, there may be a clearance of between 0.010"–0.060" at 96 and 97. Rectilinear corner or apex 94A will have a representative, generally a pair, of drilled and tapped (threaded) apertures each of which will receive a set screw 91. The tightening down of the respective screws 91 produces the engagement of the same with the adjacent corner of member 95, which producing a thrusting of the upper and left, outer surfaces of member 95 against the corresponding inner surfaces of member 94, completing a perfect alignment of the parts involved. This avoids the employment of multiple set screws disposed about the periphery of a tubular member and the progressive tightening of the same in a manner as to avoid an askew alignment.

As to operation, the structures of FIGS. 6, 7 and 8 operate essentially in the same fashion as the structure of FIG. 1, but with the provision of flexibility and positive alignment features.

While particular embodiments of the present invention have been shown and described it will be obvious to those skilled in the art that various changes and modifications may be made without departing from the essential aspects of the invention and therefore, the aim in the appended claims is to cover all such changes and modifications as fall within the true spirit and scope of the invention.

What I claim is:

1. Suspended seating apparatus including, in combination, an upstanding post having an upper end and a lower end, a composite arm having a first member secured to and laterally extending from said upper end and a second member secured to, axially extending from, and telescopingly engaged with respect to said first member, a vertically aligned journal box secured to said second member, at least one chair support arm depending from and journaled for vertical axis rotational displacement with respect to said journal box, structure secured to said chair support arm and constructed for supporting attachment to selected external seating structure, and extensible base support structure secured to said post at said lower end and projecting laterally outwardly vertically underneath said composite arm and also said journal box a distance from said post at least as great as the distance of said journal box from said post, whereby to lend fulcrum-like support to said apparatus against load-imposed outward tipping tendencies.

2. The apparatus of claim 1 wherein said apparatus includes means for fixing the extended disposition of said first member relative to said second member and also means for fixing the extension of said base support structure.

3. The apparatus of claim 1 wherein said apparatus includes adjustable means for releasably fixing the extended disposition of said first member relative to said second member and also adjustable means for fixing the extension of said base support structure.

4. The apparatus of claim 1 wherein said first and second members are of complementary transverse rectangular cross-section, said first member telescopingly receives said second member, said first member being provided with means for adjustably fixing the axial disposition of said second member relative to said first member.

5. The apparatus of claim 1 wherein said base support structure includes an outwardly and laterally extending tubular receptacle of transverse square cross-section, a base arm extension of corresponding square cross-section telescoping within said tubular receptacle, means for fixing the transverse disposition of and extension within said tubular receptacle by said base arm extension, and laterally and oppositely extending cross arm structure secured to said base arm extension.

6. The apparatus of claim 5 wherein said cross arm structure includes a cross arm receptacle secured to said base arm extension, and an adjustable member telescopingly disposed within and oppositely extending from said cross arm receptacle.

7. The apparatus of claim 5 wherein said base support structure includes a series of mutually spaced, adjustable leveling means, and threaded means horizontally spaced from said leveling means for securing said apparatus at said base support structure to flooring.

8. The apparatus of claim 5 wherein said apparatus is provided with step structure elevated above and positioned over said base support structure.

9. The apparatus of claim 1 wherein said upstanding post is itself comprised of a pair of telescoping members, said first and said second members of said composite arm having essentially corresponding rectangular transverse cross-sections respectively defined by outer, transverse, rectangular peripheries, having rectilinear corners, and being mutually secured together by set screws passing at an oblique angle through a corner of the outermost one of said first and second members to engage and thrust against a corner of the innermost one of said first and second members.

10. Suspended seating apparatus including, in combination, an upstanding post having an upper end and a lower end, a composite arm having a first member secured to and laterally extending from said upper end and a second member secured to, axially extending from, and telescopingly engaged with respect to said first member, a first journal box secured to said second member, at least one hollow chair support arm depending from and journaled for axial rotational displacement about a vertical axis with respect to said first journal box, said chair support arm being provided with a seat plate having a depending hollow shaft provided an interior, transversely mounted first cross-pin anchor, a second journal box secured to an extremity of said chair support arm and journalling said depending hollow shaft, a first torsion-operative return-spring means, having an upper looped end hooked over said cross-pin anchor and a lower curved end keyed to and retained by said second journal box, intercoupling said shaft with said second journal box, whereby to return, by the transverse torsional movement of said spring means, said seat plate to a desired position when not in supportive use, a lower hollow portion of said second journal box having downwardly facing keyway slots, an upstanding triangular retainer key seated in said slots and having an aperture retentively receiving said lower curved end of said turn spring means, whereby said lower curved end is in fact keyed to and retained by said second journal box as aforesaid, and base support structure secured to said post at said lower end and extending laterally outwardly underneath said composite arm, whereby to lend support to said apparatus.

11. The apparatus of claim 10 wherein said first journal box is provided an upper hollow portion having upwardly facing keyway slots, a triangular second retainer key fitting into said slots and having a downwardly projecting portion provided an aperture, said hollow chair support arm having a transversely mounted, second spring retainer pin, a second torsion-operative return spring means for effecting chair support arm return, said second return spring means having opposite curved ends, one of said ends of said second spring return means being hooked over said second spring retainer pin, the remaining one of said ends of said second spring return means being hooked through said second retainer key aperture, said first journal box thereby being provided with said torsion spring return means, so anchored to and between said first journal box and said chair support arm, for returning said chair support arm to a desired position when said support arm is not in supportive use.

12. The apparatus of claim 10 where in said first journal box journallingly receives a pair of downwardly and outwardly extending chair support arms for supporting a pair of external chairs.

13. Suspended seating apparatus including, in combination, an upstanding post having an upper end and a lower end, a composite arm having a first member secured to and laterally extending from said upper end and a second member secured to, axially extending from, and telescopingly engaged with respect to said first member, a journal box secured to said second member, at least one chair support arm secured to, depending from, and journaled for axial rotational displacement about a vertical axis with respect to said journal box, structure secured to said chair support arm and constructed for supporting attachment to selected external seating structure, and base support structure secured to said post at said lower end and projecting laterally outwardly for positionment vertically underneath said composite arm and said journal box, whereby to lend fulcrum-like support to said apparatus, said base support structure including an outwardly and laterally extending tubular receptacle of transverse square cross-section, a base arm extension telescoping with respect to and within said tubular receptacle and being of complementary square cross-section, means for fixing the disposition of and extension within said tubular receptacle by said base arm extension, and laterally and oppositely extending cross arm structure secured to said base arm extension, said base arm extension and tubular receptacle being constructed and arranged, through ninety-degree mutual rotative displacement, for enabling both horizontal and, alternately, upstanding disposition of said cross arm structure as to be parallel with said post, whereby to condition said structure for stackable shipping condition.

14. Suspended seating apparatus including, in combination, an upstanding post, elongated cantilever structure secured to an upper portion of said post, base support structure positioned vertically beneath said cantilever structure and secured to a lower portion of said post, and a support-seat arm having an upper essentially vertical portion, vertically positioned above said base support structure and journalled to said cantilever structure for axially vertical rotative movement, and also an outwardly extending lower portion, and person-support means secured to said outwardly extending lower portion, said support-seat arm being positioned between said cantilever structure and said base support structure.

15. The apparatus of claim 14 wherein said base support structure is provided with brackets having lower flanges, threaded leveling means threadedly engaging said flanges, and threaded securement means respectively mutually spaced from said threaded leveling means also provided said flanges for securing said base support structure to external flooring.

16. Suspended seating apparatus including, in combination, an upstanding post, an extensible upper arm structure secured to an upper portion of said post, an extensible base support structure secured to a lower portion of said upstanding post, said upper arm structure including an outer extremity journal box means constructed for receiving, for axial rotational displacement about a vertical axis, at least one depending seat support arm, said extensible base support structure including a toe essentially defining a fulcrum positionable, relative to said upstanding post, at least as far from said post as said journal box means.

17. The apparatus of claim 16 wherein said base structure includes laterally oppositely extending cross member structure positioned interior of said toe but spaced from said post structure.

18. The apparatus of claim 17 wherein said cross member structure and said toe include depending floor-adjustment means for effecting horizontal-leveling of said apparatus.

* * * * *